US008491329B2

(12) United States Patent
Hsu

(10) Patent No.: US 8,491,329 B2
(45) Date of Patent: Jul. 23, 2013

(54) ELECTRICAL OUTLET ASSEMBLY AND MANUFACTURING METHOD THEREOF

(75) Inventor: Jung-Hui Hsu, Taipei County (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 153 days.

(21) Appl. No.: 12/944,066

(22) Filed: Nov. 11, 2010

(65) Prior Publication Data

US 2012/0034801 A1 Feb. 9, 2012

(30) Foreign Application Priority Data

Aug. 4, 2010 (TW) ..... 99125952 A

(51) Int. Cl.
*H01R 13/72* (2006.01)

(52) U.S. Cl.
USPC ..... 439/501

(58) Field of Classification Search
USPC ..... 439/501–503, 638, 652, 214, 490, 439/188, 441
See application file for complete search history.

(56) References Cited

U.S. PATENT DOCUMENTS 7,635,273 B2 * 12/2009 Buzil et al. ..... 439/214
7,942,693 B2 * 5/2011 Dennes ..... 439/535
2006/0258226 A1 * 11/2006 Milan ..... 439/652
2008/0012423 A1 * 1/2008 Mimran ..... 307/11
2009/0258533 A1 * 10/2009 Dennes et al. ..... 439/395
2011/0287665 A1 * 11/2011 Chien ..... 439/638
2012/0064760 A1 * 3/2012 Dietz et al. ..... 439/502

FOREIGN PATENT DOCUMENTS

TW I236190 B 7/2005
TW M335071 U 6/2008

OTHER PUBLICATIONS

Communication From Taiwan Patent Office Regarding a Counterpart Taiwan Application Dated Dec. 22, 2012.

* cited by examiner

*Primary Examiner* — Jean F Duverne
(74) *Attorney, Agent, or Firm* — Rosenberg, Klein & Lee

(57) ABSTRACT

An electrical outlet assembly includes: a housing having an upper casing and a bottom casing, the upper casing having a plurality of openings, the upper casing and the bottom casing being assembled with each other to form a receiving room; a switch module, having a switch, a surge arrester and a first casing, the switch being electrically connected with the surge arrester; at least one electrical outlet module, having a second casing; a cable set disposed in the receiving room, the cable set being electrically connected with the switch module and the electrical outlet module; wherein the switch module and the electrical outlet module are respectively disposed in the openings, and the switch module and the electrical outlet module are arranged on the housing.

12 Claims, 7 Drawing Sheets

ELECTRICAL OUTLET ASSEMBLY AND MANUFACTURING METHOD THEREOF

BACKGROUND OF THE INVENTION

1. Field of the Invention

The present invention is an electrical outlet assembly; especially, the present invention relates to an electrical outlet assembly having random arranged sockets and the manufacturing method thereof.

2. Description of Related Art

The traditional electrical outlet assembly 1 having a housing 12, as shown in FIG. 1, has sockets 15 with the same function. If the electronic device has different plug from the electrical outlet assembly 1, the device cannot gain the electrical power from the electrical outlet assembly 1. While powering two precision instruments and one cell phone, two sockets with anti-detachment device or with surge arrester and one USB socket are needed. Therefore, the traditional electrical outlet assembly 1 cannot efficiently supply power to devices of various power connections.

On the other hand, when client want to change the socket type and the positions of the socket, new molds and new tools have to be developed for manufacturing the new electrical outlet assembly 1. As a result, the manufacturing efficiency cannot be improved and the cost is increased. Therefore, the above-mentioned problem results in the bottleneck of the manufacturing procedure.

The present invention is provided for an electrical outlet assembly. The sockets of various functions can be selected on the housing and the amount of the sockets can also be adjusted.

Consequently, with regard to the resolution of defects illustrated hereinbefore, the inventors of the present invention propose a reasonably and effectively designed solution for effectively eliminating such defects.

SUMMARY OF THE INVENTION

The objective of the present invention is to provide an electrical outlet assembly and a manufacturing method thereof. The housing of the electrical outlet assembly has a plurality of openings for assembling a switch module and/or electrical outlet modules. Therefore, the switch module and/or electrical outlet modules can be selected and arranged on the housing.

The present invention discloses an electrical outlet assembly, comprising: a housing having an upper casing and a bottom casing, the upper casing having a plurality of openings, the upper casing and the bottom casing being assembled with each other to form a receiving room; a switch module, having a switch, a surge arrester and a first casing, the switch being electrically connected with the surge arrester; at least one electrical outlet module, having a second casing; a cable set disposed in the receiving room, the cable set being electrically connected with the switch module and the electrical outlet module; wherein the switch module and the electrical outlet module are respectively disposed in the openings, and the switch module and the electrical outlet module are arranged on the housing.

The electrical outlet assembly of the present invention has a switch module and at least one electrical outlet module. The switch module includes a switch and a surge arrester for protecting the electrical outlet assembly from line surge. The electrical outlet module can be the socket having an USB charging device, the socket having an anti-detachment device, the socket having an auxiliary switch, the socket having a dustproof cover or a general socket. The amount and the arrangement of the above-mentioned sockets can be selected according to the requirement of applications. On the other hand, the above-mentioned sockets respectively have one independent casing so that the sockets are efficiently assembled with the hosing. Thus, the manufacturing procedures can be flexibly adjusted, the manufacturing efficiency is improved and the manufacturing cost is reduced.

In order to further appreciate the characteristics and technical contents of the present invention, references are hereunder made to the detailed descriptions and appended drawings in connection with the present invention. However, the appended drawings are merely shown for exemplary purposes, rather than being used to restrict the scope of the present invention.

DETAILED DESCRIPTION OF THE PREFERRED EMBODIMENTS

Figure 1:
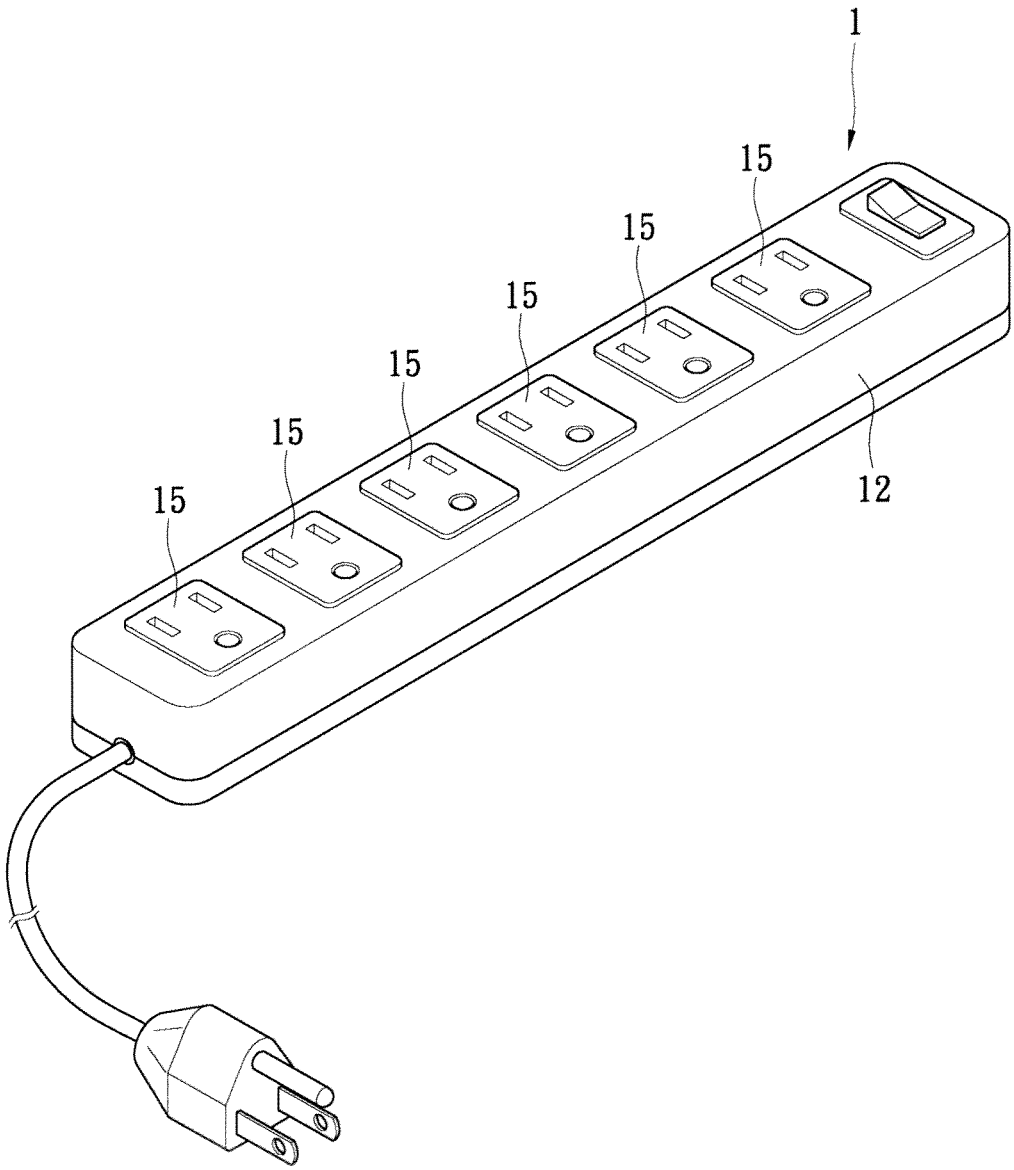
FIG. 1 PRIOR ART
FIG. 1 is a structural diagrams of a traditional electrical outlet assembly.
Figure 2:
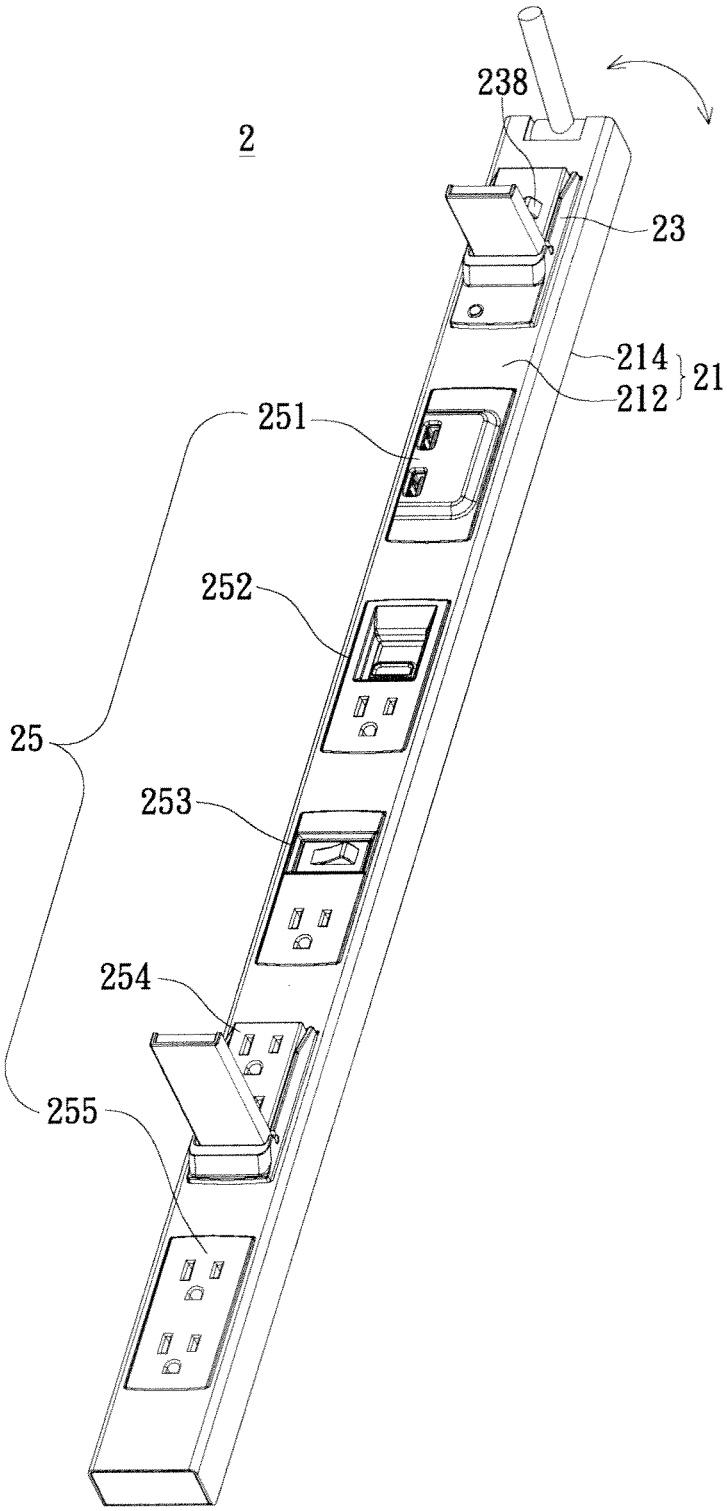
FIG. 2 is a structural diagrams of an electrical outlet assembly according to the present invention.
Figure 3:
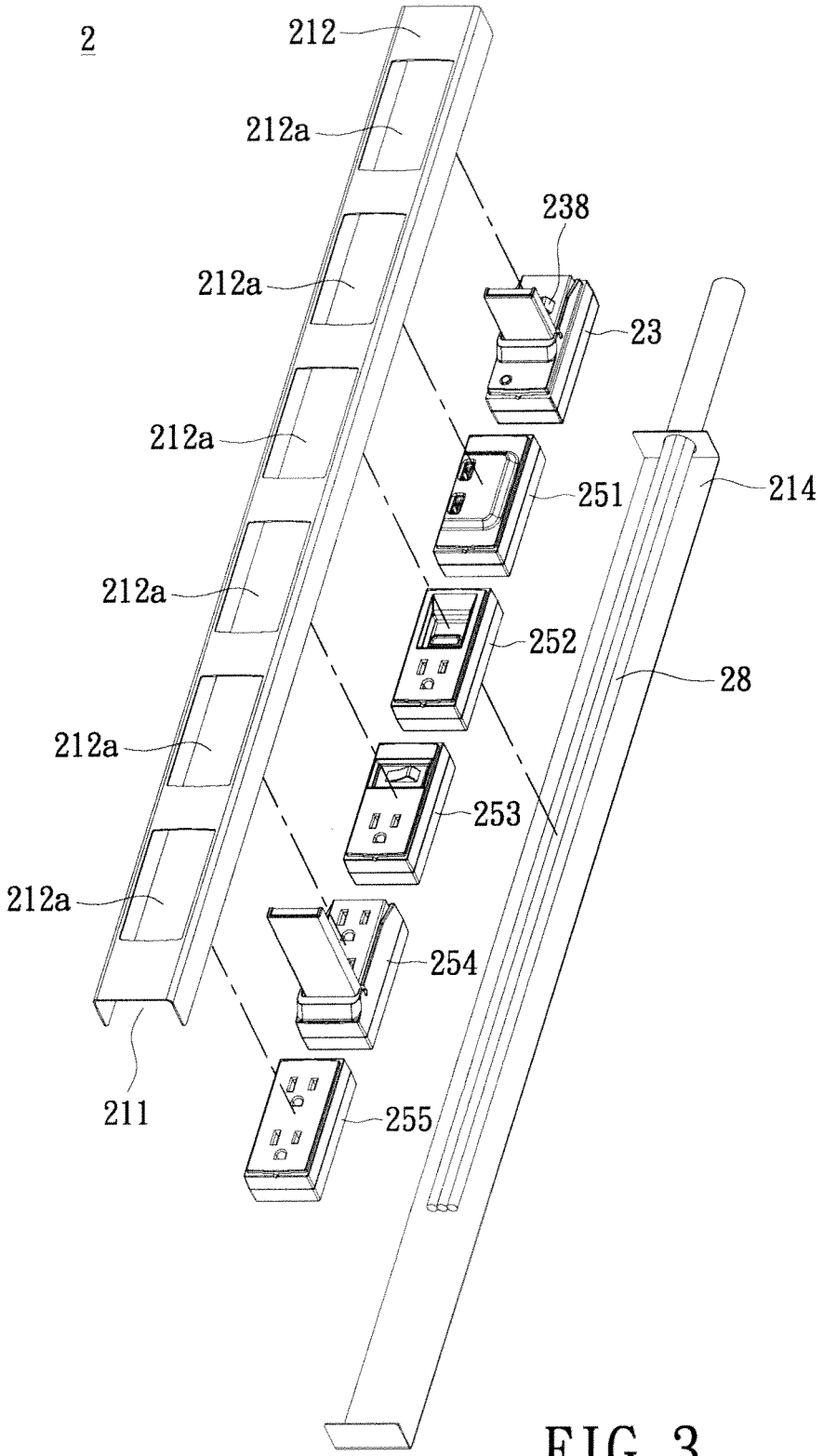
FIG. 3 is a exploded diagrams of an electrical outlet assembly according to the present invention.

Please refer to FIGS. 2 and 3, in which the perspective and exploded diagrams of the electrical outlet assembly 2 are shown. The electrical outlet assembly 2 has a housing 21, a switch module 23, at least one electrical outlet module 25, and a cable set 28. The housing 21 has an upper casing 212 and a bottom casing 214. The upper casing 212 and the bottom casing 214 are assembled with each other to form a receiving room 211. The upper casing 212 can be made of metal and has a plurality of openings 212*a*. The switch module 23 and the electrical outlet module 25 respectively have a casing (i.e., first casing and second casing). The openings 212*a* are corresponding to the casings of the switch module 23 and the electrical outlet module 25 so that the switch module 23 and the electrical outlet module 25 can be disposed in the openings 212*a*, and the switch module 23 and the electrical outlet module 25 are arranged on the housing 21. Therefore, various types of electrical outlets can be collected in the electrical outlet assembly 2 and the electrical outlet assembly 2 can be efficiently manufactured. Moreover, the manufacturing cost can be reduced.

Figure 4A:
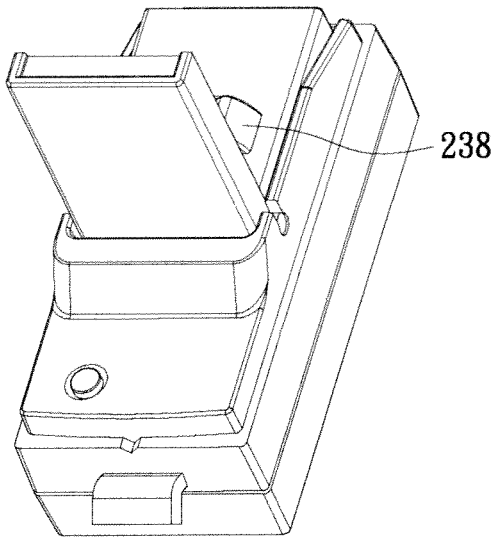
FIG. 4A is structural diagrams of the switch module according to the present invention.

As shown in FIG. 4A; the switch module 23 has a switch 238 and a surge arrester (not shown). The switch 238 is electrically connected to the surge arrester. When the switch 238 is pressed and turned on, the surge arrester is correspondingly on the function state. Accordingly, while inserting electronic devices into the electrical outlet assembly 2, the electronic devices can be protected from the current overload resulted from the lightning.

Figure 4B:
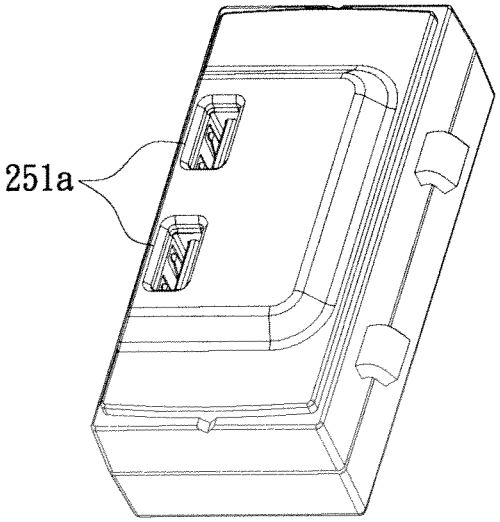
FIG. 4B is structural diagrams of the socket having an USB charging device according to the present invention.
Figure 4C:
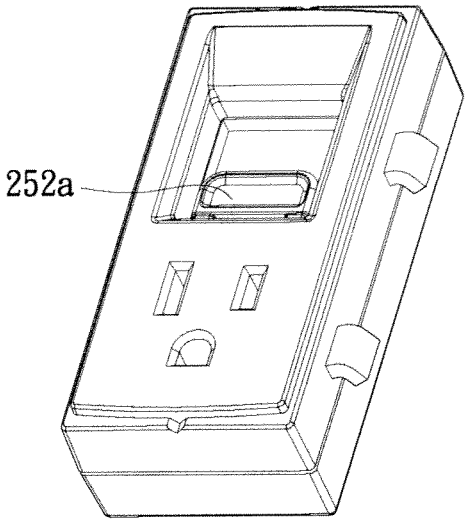
FIG. 4C is structural diagrams of the socket having an anti-detachment device according to the present invention.
Figure 4D:
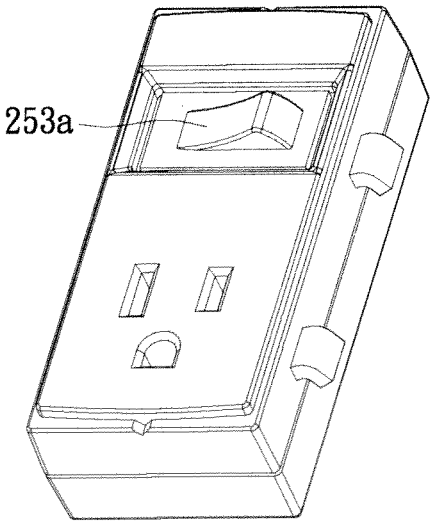
FIG. 4D is structural diagrams of the socket having an auxiliary switch according to the present invention.
Figure 4E:
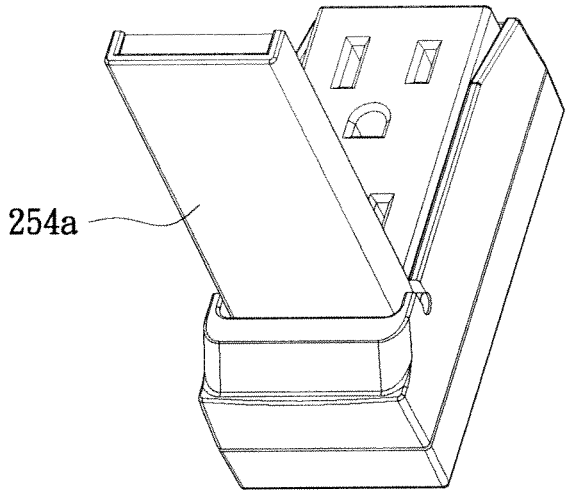
FIG. 4E is structural diagrams of the socket having a dustproof cover according to the present invention.

A socket 251 having an USB charging device 251*a* is shown in FIG. 4B. The socket 251 having an USB charging device is assembled on the housing 21 so that an electronic device with an USB plug can be inserted into the socket 251 to obtain the electrical power. A socket 252 having an anti-detachment device 252*a* is shown in FIG. 4C. The anti-detachment device 252*a* is used to prevent the inserted plug form detachment. A socket 253 having an auxiliary switch 253*a* is shown in FIG. 4D. Users can independently control the socket 253 in broken circuit or closed circuit by switching the auxiliary switch 253*a*. A socket 254 having a dustproof cover 254*a* is shown in FIG. 4E. The dustproof cover 254*a* is used to cover the socket and to prevent the socket form dust. Therefore, the safety of using the socket is improved. In the present, the electrical outlet module 25 can be the above-mentioned socket 251 having an USB charging device 251*a*, the socket 252 having an anti-detachment device 252*a*, the socket 253 having an auxiliary switch 253*a*, the socket 254 having a dustproof cover 254*a* or a general socket 255. The above-mentioned sockets 251 to 255 can be randomly selected and then be assembled with the housing 21 and the manufactured electrical outlet assembly 2 can have various functions so as to meet the various requirements. Therefore, the problem of the single kind of sockets can be solved. On the other hand, the above-mentioned sockets 251 to 255 are the exemplary examples and the socket can have dual or multi functions. For example, the socket of the instant invention can has an auxiliary switch 253*a* and a dustproof cover 254*a* simultaneously. The person skilled in the art can adjust the functions of sockets according to the application.

Figure 5A:
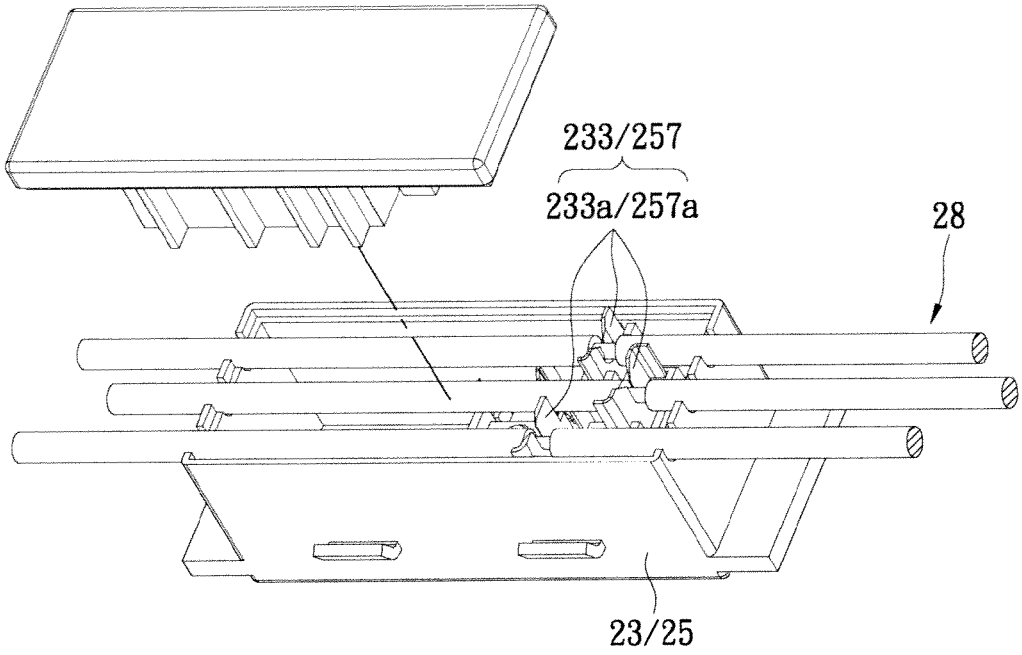
FIG. 5A is exploded diagrams of the insulation-displacement-contact terminal according to the present invention.
Figure 5B:
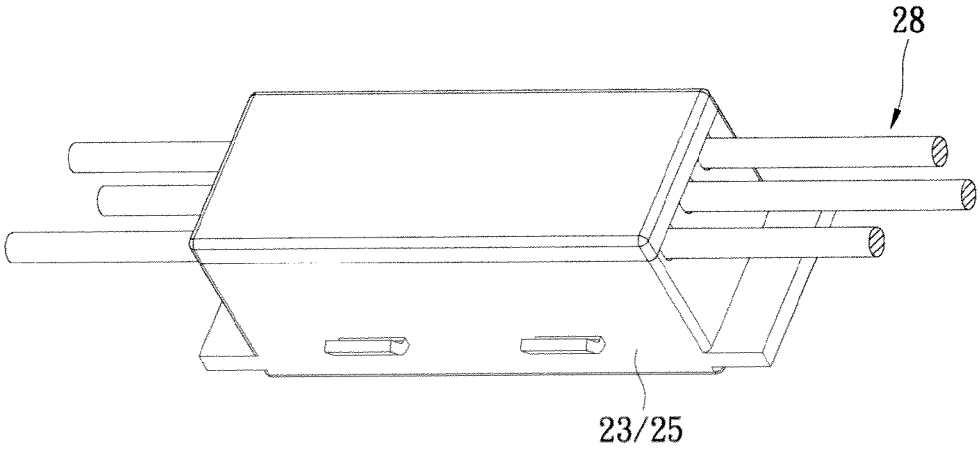
FIG. 5B is structural diagrams of the insulation-displacement-contact terminal according to the present invention.

Please refer to FIGS. 5A and 5B; the switch module 23 further has a first insulation-displacement-contact (IDC) terminal 233 to electrically connect to the cable set 28. The first insulation-displacement-contact terminal 233 can have a plurality of shaped plates 223*a* so that when the switch module 23 is pressed to the cable set 28, the plates 223*a* are used to insert through an insulation layer of the cable set 28. Therefore, the plates 223*a* can electrically connect to an inner conductor (i.e., Cu conducting lines) of the cable set 28, and the switch module 23 are connected electrically to the cable set 28. Similarly, the electrical outlet module 25 further has a second insulation-displacement-contact terminal 257. The second insulation-displacement-contact terminal 257 can have a plurality of shaped plates 257*a* so that when the electrical outlet module 25 is pressed to the cable set 28, the plates 257*a* are used to insert through an insulation layer of the cable set 28. Therefore, the plates 257*a* can electrically connect to an inner conductor (i.e., Cu conducting lines) of the cable set 28, and the electrical outlet module 25 are connected electrically to the cable set 28. Accordingly, the switch module 23 and the electrical outlet module 25 are electrically connected to the cable set 28 by insertion and pressing methods. By the exemplary method, the electrical outlet module 25 and the switch module 23 are efficiently assembled on the housing 21 and electrically connected to the cable set 28. However, the switch module 23 and the electrical outlet module 25 can be welded with or screwed to the inner conductor of the cable set 28 in another example.

In addition, a manufacturing method of electrical outlet assembly 2 as illustrated in FIGS. 2 to 5B. The first step (a) is providing a hosing 21 and a cable set 28. The housing 21 has an upper casing 212 and a bottom casing 214. The upper casing 212 and the bottom casing 214 are assembled with each other to form a receiving room 211. Furthermore, the cable set 28 is disposed in the receiving room 211 and the upper casing 212 has a plurality of openings 212*a* thereon.

Step (b) is assembling a switch module 23 in the receiving room 211 correspondingly to one of the openings 212*a* of the upper casing 212. The switch module 23 has a switch 238, a surge arrester, and a first insulation-displacement-contact terminal 233. The switch 238 is electrically connected with the surge arrester. Step (c) is inserting the first insulation-displacement-contact terminal 233 into the cable set 28. In detail, a plurality of shaped plates 223*a* of the first insulation-displacement-contact terminal 233 is inserted through an insulation layer of the cable set 28 for exploding the inner conductor (i.e., Cu conducting line) of the cable set 28. Thus, the first insulation-displacement-contact terminal 233 can electrically connect to the cable set 28. Moreover, the casing (i.e., the first casing) of the switch module 23 is fixed on the upper casing 212 or the bottom casing 214 by hooking or locking methods.

Step (d) is assembling at least one electrical outlet module 25 in the receiving room 211 correspondingly to the remaining openings 212*a* of the upper casing 212. The electrical outlet module 25 has a second insulation-displacement-contact terminal 257. Step (e) is similar with the Step (c) and is inserting the second insulation-displacement-contact terminal 257 into the cable set 28. In detail, a plurality of shaped plates 257*a* of the second insulation-displacement-contact terminal 257 is inserted through an insulation layer of the cable set 28 for exploding the inner conductor (i.e., Cu conducting line) of the cable set 28. Thus, the second insulation-displacement-contact terminal 257 can electrically connect to the cable set 28. In the step (d), the electrical outlet module 25 can be any type of socket(s), for example, the electrical outlet module 25 can be the socket 251 having an USB charging device 251*a*, the socket 252 having an anti-detachment device 252*a*, the socket 253 having an auxiliary switch 253*a*, the socket 254 having a dustproof cover 254*a* or a general socket 255. The amount and the arrangement of the above-mentioned sockets 251 to 255 can be selected according to the requirement of applications. On the other hand, the above-mentioned sockets 251 to 255 respectively have one independent casing so that the sockets are efficiently assembled with the hosing 21. Moreover, the casing (i.e., the second casing) of the electrical outlet module 25 is fixed on the upper casing 212 or the bottom casing 214 by hooking or locking methods.

Accordingly, the present invention provides for an electrical outlet assembly 2 having a switch module 23 with a surge arrester and at least one electrical outlet module 25. The electrical outlet assembly 2 has a housing 21 and the housing 21 defines a receiving room 212*a* for accommodating the switch module 23 and the electrical outlet module 25. The electrical outlet module 25 can have various types of sockets and the arrangement of the sockets can be adjusted and changed easily. The manufacturing method of the electrical outlet assembly 2 is further introduced. The selected sockets can be efficiently assembled on the housing 21. Moreover, when users want to change the electrical outlet assembly 2, the new types of sockets can be chosen and assembled on the original upper casing 212. The un-assembled sockets can be retained for next usage. Therefore, the present invention provides for environment protection and reducing the manufacturing cost.

What is claimed is:

1. An electrical outlet assembly, comprising:

a housing having an upper casing and a bottom casing, the upper casing having a plurality of openings, the upper casing and the bottom casing being assembled with each other to form a receiving room;

a switch module, having a switch, a surge arrester and a first casing, the switch being electrically connected with the surge arrester;

at least one electrical outlet module, having a second casing; and a cable set disposed in the receiving room, the cable set being electrically connected with the switch module and the electrical outlet module, wherein the switch module has a first insulation-displacement-contact terminal, the first insulation-displacement-contact terminal inserts through an insulation layer of the cable set so that the switch module electrically connects to an inner conductor of the cable set, the electrical outlet module has a second insulation-displacement-contact terminal, the second insulation-displacement-contact terminal inserts through the insulation layer of the cable set so that the electrical outlet module electrically connects to the inner conductor of the cable set;

wherein the switch module and the electrical outlet module are respectively disposed in the openings, and the switch module and the electrical outlet module are arranged on the housing.

2. The electrical outlet assembly according to claim 1, wherein the upper casing of the housing is made of metal, the electrical outlet module includes a first socket having an USB charging device and a second socket having an anti-detachment device.

3. The electrical outlet assembly according to claim 1, wherein the upper casing of the housing is made of metal, the electrical outlet module includes a first socket having an USB charging device and a second general socket.

4. The electrical outlet assembly according to claim 1, wherein the upper casing of the housing is made of metal, the electrical outlet module includes a first socket having an anti-detachment device and a second general socket.

5. The electrical outlet assembly according to claim 1, wherein the upper casing of the housing is made of metal, the electrical outlet module includes a first socket having an auxiliary switch and a second general socket.

6. The electrical outlet assembly according to claim 1, wherein the upper casing of the housing is made of metal, the electrical outlet module includes a first socket having a dustproof cover and a second general socket.

7. The electrical outlet assembly according to claim 1, wherein the upper casing of the housing is made of metal, the electrical outlet module includes a first socket having a dustproof cover and a second socket of an USB charging device.

8. The electrical outlet assembly according to claim 1, wherein the upper casing of the housing is made of metal, the electrical outlet module includes a first socket having a dustproof cover and a second socket having an auxiliary switch.

9. The electrical outlet assembly according to claim 1, wherein the upper casing of the housing is made of metal, the electrical outlet module includes a first socket having a dustproof cover and a second socket having an anti-detachment device.

10. The electrical outlet assembly according to claim 1, wherein the upper casing of the housing is made of metal, the electrical outlet module includes a first socket having an anti-detachment device and a second socket having an auxiliary switch.

11. The electrical outlet assembly according to claim 1, further comprising a switch module individually arranged in the housing and has an insulation-displacement-contact terminal inserted through the insulation layer of the cable set to electrically connect to the inner conductor of the cable set.

12. The electrical outlet assembly according to claim 1, the electrical outlet modules further includes a socket having an USB charging device, a socket having an auxiliary switch, or a socket having a dustproof cover, each of the electrical outlet modules has an individual cashing, the casings of the electrical outlet modules are fixed to the hosing by hooking or locking methods.

* * * * *